US009931849B2

(12) United States Patent
Katoh et al.

(10) Patent No.: US 9,931,849 B2
(45) Date of Patent: Apr. 3, 2018

(54) LIQUID EJECTION APPARATUS, INKJET SYSTEM, AND FLUSHING METHOD

(71) Applicants: Ryuuta Katoh, Kanagawa (JP); Shino Sasaki, Kanagawa (JP); Yukihito Niino, Tokyo (JP)

(72) Inventors: Ryuuta Katoh, Kanagawa (JP); Shino Sasaki, Kanagawa (JP); Yukihito Niino, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/404,263

(22) Filed: Jan. 12, 2017

(65) Prior Publication Data

US 2017/0203570 A1 Jul. 20, 2017

(30) Foreign Application Priority Data

Jan. 14, 2016 (JP) ..... 2016-005547
Dec. 1, 2016 (JP) ..... 2016-234477

(51) Int. Cl.
*B41J 2/165* (2006.01)

(52) U.S. Cl.
CPC ..... *B41J 2/1652* (2013.01)

(58) Field of Classification Search
CPC ..... B41J 2/1652
USPC ..... 347/35
See application file for complete search history.

(56) References Cited

U.S. PATENT DOCUMENTS

2010/0245919 A1* 9/2010 Kanzaki ..... B41J 2/16585 358/1.17
2012/0075377 A1* 3/2012 Kyotani ..... B41J 2/16526 347/16
2013/0063507 A1 3/2013 Sasaki
2015/0116400 A1 4/2015 Sasaki

FOREIGN PATENT DOCUMENTS

JP 2015-058556 3/2015
JP 2015-058557 A 3/2015

OTHER PUBLICATIONS

Extended European Search Report for Corresponding European Application No. 17151185.0 dated Sep. 27, 2017.

* cited by examiner

*Primary Examiner* — Huan Tran
*Assistant Examiner* — Alexander D Shenderov
(74) *Attorney, Agent, or Firm* — Harness, Dickey & Pierce, P.L.C.

(57) ABSTRACT

A liquid ejection apparatus includes: a plurality of nozzles configured to eject liquid onto a conveyed object conveyed by a conveyance unit, based on input image data; and a control unit configured to control a number of droplets in first flushing for ejecting the liquid outside a region corresponding to the image data and a number of droplets in second flushing for ejecting the liquid inside the region corresponding to the image data in addition to ejection based on the image data. The control unit is configured to control the number of droplets in the first flushing and the number of droplets in the second flushing based on at least a length of the image data in a direction in which the conveyed object is conveyed.

14 Claims, 10 Drawing Sheets

FIG.6

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | $D_{11}$ | $D_{12}$ | $D_{13}$ | $D_{14}$ | · | · | · | · | · | · | $D_{1n}$ |
| 2 | $D_{21}$ | $D_{22}$ | $D_{23}$ | $D_{24}$ | · | · | · | · | · | · | $D_{2n}$ |
| 3 | $D_{31}$ | $D_{32}$ | $D_{33}$ | $D_{34}$ | · | · | · | · | · | · | $D_{3n}$ |
| 4 | $D_{41}$ | $D_{42}$ | $D_{43}$ | $D_{44}$ | · | · | · | · | · | · | $D_{4n}$ |
| · | · | · | · | · | · | · | · | · | · | · | · |
| · | · | · | · | · | · | · | · | · | · | · | · |
| n | $D_{n1}$ | $D_{n2}$ | $D_{n3}$ | $D_{n4}$ | · | · | · | · | · | · | $D_{nn}$ |

FIG.7

| TYPE OF RECORDING MEDIUM | NON-EJECTION PERIOD [s] | | | | | | |
|---|---|---|---|---|---|---|---|
| | $t_1$ | $t_2$ | $t_3$ | $t_4$ | · | · | $t_n$ |
| $P_1$ | $T_{11}$ | $T_{12}$ | $T_{13}$ | $T_{14}$ | · | · | $T_{1n}$ |
| $P_2$ | $T_{21}$ | $T_{22}$ | $T_{23}$ | $T_{24}$ | · | · | $T_{2n}$ |
| $P_3$ | $T_{31}$ | $T_{32}$ | $T_{33}$ | $T_{34}$ | · | · | $T_{3n}$ |
| $P_4$ | $T_{41}$ | $T_{42}$ | $T_{43}$ | $T_{44}$ | · | · | $T_{4n}$ |
| · | · | · | · | · | · | · | · |
| · | · | · | · | · | · | · | · |
| $P_n$ | $T_{n1}$ | $T_{n2}$ | $T_{n3}$ | $T_{n4}$ | · | · | $T_{nn}$ |

| THICKNESS OF RECORDING MEDIUM | NON-EJECTION PERIOD [s] | | | | | | |
|---|---|---|---|---|---|---|---|
| | $t_1$ | $t_2$ | $t_3$ | $t_4$ | · | · | $t_n$ |
| $L_1$ | $T_{11}$ | $T_{12}$ | $T_{13}$ | $T_{14}$ | · | · | $T_{1n}$ |
| $L_2$ | $T_{21}$ | $T_{22}$ | $T_{23}$ | $T_{24}$ | · | · | $T_{2n}$ |
| $L_3$ | $T_{31}$ | $T_{32}$ | $T_{33}$ | $T_{34}$ | · | · | $T_{3n}$ |
| $L_4$ | $T_{41}$ | $T_{42}$ | $T_{43}$ | $T_{44}$ | · | · | $T_{4n}$ |
| · | · | · | · | · | · | · | · |
| · | · | · | · | · | · | · | · |
| $L_n$ | $T_{n1}$ | $T_{n2}$ | $T_{n3}$ | $T_{n4}$ | · | · | $T_{nn}$ |

| DRYING MEANS | NON-EJECTION PERIOD [s] | | | | | | |
|---|---|---|---|---|---|---|---|
| | $t_1$ | $t_2$ | $t_3$ | $t_4$ | · | · | $t_n$ |
| $H_1$ | $T_{11}$ | $T_{12}$ | $T_{13}$ | $T_{14}$ | · | · | $T_{1n}$ |
| $H_2$ | $T_{21}$ | $T_{22}$ | $T_{23}$ | $T_{24}$ | · | · | $T_{2n}$ |
| $H_3$ | $T_{31}$ | $T_{32}$ | $T_{33}$ | $T_{34}$ | · | · | $T_{3n}$ |
| $H_4$ | $T_{41}$ | $T_{42}$ | $T_{43}$ | $T_{44}$ | · | · | $T_{4n}$ |
| · | · | · | · | · | · | · | · |
| · | · | · | · | · | · | · | · |
| $H_n$ | $T_{n1}$ | $T_{n2}$ | $T_{n3}$ | $T_{n4}$ | · | · | $T_{nn}$ |

| TYPE OF INK | NON-EJECTION PERIOD [s] | | | | | | |
|---|---|---|---|---|---|---|---|
| | $t_1$ | $t_2$ | $t_3$ | $t_4$ | · | · | $t_n$ |
| $I_1$ | $T_{11}$ | $T_{12}$ | $T_{13}$ | $T_{14}$ | · | · | $T_{1n}$ |
| $I_2$ | $T_{21}$ | $T_{22}$ | $T_{23}$ | $T_{24}$ | · | · | $T_{2n}$ |
| $I_3$ | $T_{31}$ | $T_{32}$ | $T_{33}$ | $T_{34}$ | · | · | $T_{3n}$ |
| $I_4$ | $T_{41}$ | $T_{42}$ | $T_{43}$ | $T_{44}$ | · | · | $T_{4n}$ |
| · | · | · | · | · | · | · | · |
| · | · | · | · | · | · | · | · |
| $I_n$ | $T_{n1}$ | $T_{n2}$ | $T_{n3}$ | $T_{n4}$ | · | · | $T_{nn}$ |

| RECORDING RESOLUTION | NON-EJECTION PERIOD [s] | | | | | | |
|---|---|---|---|---|---|---|---|
| | $t_1$ | $t_2$ | $t_3$ | $t_4$ | · | · | $t_n$ |
| $R_1$ | $T_{11}$ | $T_{12}$ | $T_{13}$ | $T_{14}$ | · | · | $T_{1n}$ |
| $R_2$ | $T_{21}$ | $T_{22}$ | $T_{23}$ | $T_{24}$ | · | · | $T_{2n}$ |
| $R_3$ | $T_{31}$ | $T_{32}$ | $T_{33}$ | $T_{34}$ | · | · | $T_{3n}$ |
| $R_4$ | $T_{41}$ | $T_{42}$ | $T_{43}$ | $T_{44}$ | · | · | $T_{4n}$ |
| · | · | · | · | · | · | · | · |
| · | · | · | · | · | · | · | · |
| $R_n$ | $T_{n1}$ | $T_{n2}$ | $T_{n3}$ | $T_{n4}$ | · | · | $T_{nn}$ |

FIG.8A

MASK TABLE $T_{n2}$

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | ○ | ○ | ○ | ○ | · | · | ○ | · | · | × | · | × |
| 2 | ○ | ○ | ○ | ○ | · | · | × | · | · | × | · | × |
| 3 | ○ | ○ | ○ | × | · | · | × | · | · | × | · | × |
| 4 | ○ | ○ | × | × | · | · | × | · | · | × | · | × |
| · | · | · | · | · | · | · | · | · | · | · | · | · |
| · | · | · | · | · | · | · | · | · | · | · | · | · |
| n | × | × | × | × | · | · | × | · | · | × | · | × |

FIG.8B

MASK TABLE $T_{1n}$

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | ○ | ○ | ○ | ○ | · | · | × | · | · | × | · | × |
| 2 | ○ | ○ | ○ | × | · | · | × | · | · | × | · | × |
| 3 | ○ | ○ | × | × | · | · | × | · | · | × | · | × |
| 4 | ○ | × | × | × | · | · | × | · | · | × | · | × |
| · | · | · | · | · | · | · | · | · | · | · | · | · |
| · | · | · | · | · | · | · | · | · | · | · | · | · |
| n | × | × | × | × | · | · | × | · | · | × | · | × |

FIG.8C

MASK TABLE $T_{n2}+T_{1n}$

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | ○ | ○ | ○ | ○ | · | · | × | · | · | × | · | × |
| 2 | ○ | ○ | ○ | × | · | · | × | · | · | × | · | × |
| 3 | ○ | ○ | × | × | · | · | × | · | · | × | · | × |
| 4 | ○ | × | × | × | · | · | × | · | · | × | · | × |
| · | · | · | · | · | · | · | · | · | · | · | · | · |
| · | · | · | · | · | · | · | · | · | · | · | · | · |
| n | × | × | × | × | · | · | × | · | · | × | · | × |

FIG.9A

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | $D_{11}$ | $D_{12}$ | $D_{13}$ | $D_{14}$ | · | · | · | · | · | · | $D_{1n}$ |
| 2 | $D_{21}$ | $D_{22}$ | $D_{23}$ | $D_{24}$ | · | · | · | · | · | · | $D_{2n}$ |
| 3 | $D_{31}$ | $D_{32}$ | $D_{33}$ | $D_{34}$ | · | · | · | · | · | · | $D_{3n}$ |
| 4 | $D_{41}$ | $D_{42}$ | $D_{43}$ | $D_{44}$ | · | · | · | · | · | · | $D_{4n}$ |
| · | · | · | · | · | · | · | · | · | · | · | · |
| · | · | · | · | · | · | · | · | · | · | · | · |
| n | $D_{n1}$ | $D_{n2}$ | $D_{n3}$ | $D_{n4}$ | · | · | · | · | · | · | $D_{nn}$ |

FIG.9B

MASK TABLE $T_{n2}+T_{1n}$

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | ○ | ○ | ○ | ○ | · | · | × | · | · | × | · | × |
| 2 | ○ | ○ | ○ | × | · | · | × | · | · | × | · | × |
| 3 | ○ | ○ | × | × | · | · | × | · | · | × | · | × |
| 4 | ○ | × | × | × | · | · | × | · | · | × | · | × |
| · | · | · | · | · | · | · | · | · | · | · | · | · |
| · | · | · | · | · | · | · | · | · | · | · | · | · |
| n | × | × | × | × | · | · | × | · | · | × | · | × |

FIG.9C

SELECTABLE FLUSHING MEANS

| NUMBER OF LINE FLUSHING DROPLETS | NUMBER OF STAR FLUSHING DROPLETS | | | | | | | | | | |
|---|---|---|---|---|---|---|---|---|---|---|---|
| | 1 | 2 | 3 | 4 | · | · | · | · | · | · | n |
| 1 | $D_{11}$ | $D_{12}$ | $D_{13}$ | $D_{14}$ | · | · | · | · | · | · | $D_{1n}$ |
| 2 | $D_{21}$ | $D_{22}$ | $D_{23}$ | $D_{24}$ | · | · | · | · | · | · | $D_{2n}$ |
| 3 | $D_{31}$ | $D_{32}$ | $D_{33}$ | $D_{34}$ | · | · | · | · | · | · | $D_{3n}$ |
| 4 | $D_{41}$ | $D_{42}$ | $D_{43}$ | $D_{44}$ | · | · | · | · | · | · | $D_{4n}$ |
| · | · | · | · | · | · | · | · | · | · | · | · |
| · | · | · | · | · | · | · | · | · | · | · | · |
| n | $D_{n1}$ | $D_{n2}$ | $D_{n3}$ | $D_{n4}$ | · | · | · | · | · | · | $D_{nn}$ |

LIQUID EJECTION APPARATUS, INKJET SYSTEM, AND FLUSHING METHOD

CROSS-REFERENCE TO RELATED APPLICATIONS

The present application claims priority under 35 U.S.C. § 119 to Japanese Patent Application No. 2016-005547, filed Jan. 14, 2016 and Japanese Patent Application No. 2016-234477, filed Dec. 1, 2016. The contents of which are incorporated herein by reference in their entirety.

BACKGROUND OF THE INVENTION

1. Field of the Invention

The present invention relates to a liquid ejection apparatus, an inkjet system, and a flushing method.

2. Description of the Related Art

An inkjet recording apparatus, which is known as one type of liquid ejection apparatus, is an apparatus configured to eject ink as recording liquid onto a recording medium from nozzles of a recording head to form an image on the recording medium. In this type of apparatus, some nozzles may less frequently eject ink depending on image data. The nozzles with low ejection frequency cause a phenomenon that ink remains in the nozzle part to be thickened and abnormality occurs in ink ejection to cause non-ejection of ink and abnormal landing of ink. In order to avoid such a phenomenon, processing called "flushing" for discharging thickened ink is performed. Flushing is classified into line flushing for performing flushing between printing pages and star flushing for performing flushing during a printing page.

As technology for performing such flushing operation, for example, a technique described in Japanese Unexamined Patent Application Publication No. 2015-058556 (Patent Literature 1) is publicly known. In an inkjet recording apparatus disclosed in Patent Literature 1, flushing operation with ink is controlled on the basis of conveyance speed. This inkjet recording apparatus is configured to change at least one of the ejection amount of ink, the ejection speed of ink, ejection liquid droplets of ink, the amplitude of a waveform of a signal for controlling the ejection of ink, the number of inputs of the waveform, the type of the waveform, or the pulse width of the waveform.

In the case where line flushing or star flushing is performed alone, however, it is difficult to maintain print quality under certain conditions. Line flushing is a method of discharging thickened ink with as small an ink consumption amount as possible, and needs to be performed in as small a region as possible in the conveyance direction. Thus, when an image forming region in the conveyance direction is large, the discharged amount of ink needs to be increased and the thickened ink cannot be discharged for a certain period of time, with the result that abnormal landing of ink occurs at the end of the image forming region.

Star flushing is a method of ejecting ink sparsely in an image forming region irrespective of the image forming region, to discharge thickened ink. Star flushing enables a larger amount of thickened ink to be discharged by increasing the ejection amount of ink. When the ejection amount of ink is increased, however, scumming becomes conspicuous and a printed image becomes dirty. In particular, scumming is more conspicuous on a sheet such as coated paper. If the number of ink droplets necessary to discharge thickened ink is ejected, the printed image deteriorates more depending on the type of sheet.

In other words, line flushing involving ejecting ink between printing pages has a problem in that when an image forming region of a page in the conveyance direction is large, a printed image deteriorates at the end of the image forming region. Star flushing involving ejecting ink in an image forming region has a problem in that when the ejection amount of ink is increased, dirt becomes conspicuous to deteriorate printing quality.

SUMMARY OF THE INVENTION

According to one aspect of the present invention, a liquid ejection apparatus includes a plurality of nozzles and a control unit. The plurality of nozzles are configured to eject liquid onto a conveyed object conveyed by a conveyance unit, based on input image data. The control unit is configured to control a number of droplets in first flushing for ejecting the liquid outside a region corresponding to the image data and a number of droplets in second flushing for ejecting the liquid inside the region corresponding to the image data in addition to ejection based on the image data. The control unit is configured to control the number of droplets in the first flushing and the number of droplets in the second flushing based on at least a length of the image data in a direction in which the conveyed object is conveyed.

BRIEF DESCRIPTION OF THE DRAWINGS

FIG. 6 is a diagram illustrating a flushing operation selection condition table used by the control unit in FIGS. 4A and 4B;

FIG. 7 includes diagrams illustrating a list of mask table condition tables used by the control unit in FIGS. 4A and 4B;

FIGS. 8A to 8C are diagrams illustrating a mask table determination method executed by the control unit in FIGS. 4A and 4B;

FIGS. 9A to 9C are diagrams illustrating a selectable flushing operation determination method executed by the control unit in FIGS. 4A and 4B;

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
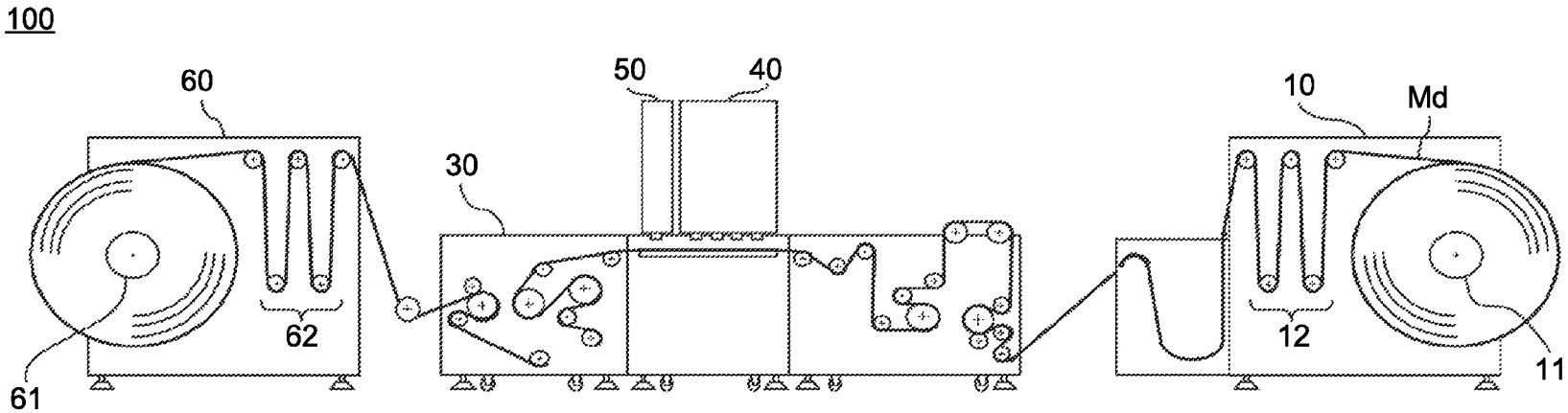
FIG. 1 is a view illustrating an overall configuration of an image forming apparatus according to embodiments of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to suppress quality degradation of an image formed by ejecting liquid.

It is an object of an embodiment to secure image quality by appropriately combining line flushing (first flushing) and star flushing (second flushing) on the basis of an image forming region of a recording medium in a conveyance direction thereof and conveyance speed of the recording medium. A description is given of a flushing method in which a flushing operation according to the present invention is used to reduce scumming in an image forming region to a certain level or less and reduce the amount of waste ink to suppress the occurrence of abnormal landing. Embodiments of the present invention are described in detail below with reference to the accompanying drawings.

An image forming apparatus according to the present embodiment is an inkjet recording apparatus for inkjet printing as an example of liquid ejection apparatuses. The inkjet recording apparatus according to the present embodiment includes ejection units of four colors of black (K), cyan (C), magenta (M), and yellow (Y). In the following description, each color of the four-color ejection units is represented by symbol in brackets.

In the present embodiment, a medium is continuous paper wound into a roll (hereinafter referred to as "rolled paper Md"). For example, the rolled paper Md is long paper wound into a roll. Long paper may have perforations formed at predetermined intervals. The present embodiment can be applied to not only rolled paper but also Z-fold paper, which is stacked on paper feeding means while being folded at predetermined locations.

FIG. 1 is a view illustrating an overall configuration of an image forming apparatus 100 according to one embodiment of the present invention. As illustrated in FIG. 1, the image forming apparatus 100 according to the present embodiment is an inkjet recording apparatus, and includes a carry-in unit 10, an image forming unit 40, a posttreatment unit 50, a drying unit 30, and a discharge unit 60 that are arranged along a conveyance direction Xm of the rolled paper Md.

The carry-in unit 10 includes a paper feeding unit 11 and a plurality of carry-in-side conveyance rollers 12, and conveys the rolled paper Md to the image forming unit 40 side. The carry-in unit 10 uses the carry-in-side conveyance rollers 12 to convey the rolled paper Md to the image forming unit 40 side while winding the rolled paper Md around a paper feeding roll in the paper feeding unit 11.

The image forming unit 40 forms an image on the rolled paper Md. The image forming unit 40 ejects liquid or liquid droplets (hereinafter referred to as "ink") on the rolled paper Md conveyed from the carry-in unit 10 to form an image on the front surface of the rolled paper Md. Details of the image forming unit 40 are described later.

The posttreatment unit 50 executes posttreatment for ejecting and depositing posttreatment liquid in a spot pattern on the front surface of the rolled paper Md having the image formed thereon by the image forming unit 40. The drying unit 30 dries the rolled paper Md post-treated by the post-treatment unit 50 by heating, for example.

The discharge unit 60 discharges the rolled paper Md having the image formed thereon. The discharge unit 60 includes a storage unit 61 and a plurality of discharge-side conveyance rollers 62. The discharge unit 60 stores therein the rolled paper Md such that the rolled paper Md having the image formed thereon is wound around a storage roll in the storage unit 61 using the discharge-side conveyance rollers 62. Thus, the carry-in unit 10 and the discharge unit 60 function as conveyance units configured to convey the rolled paper Md, which is a conveyed object.

Figure 4A:
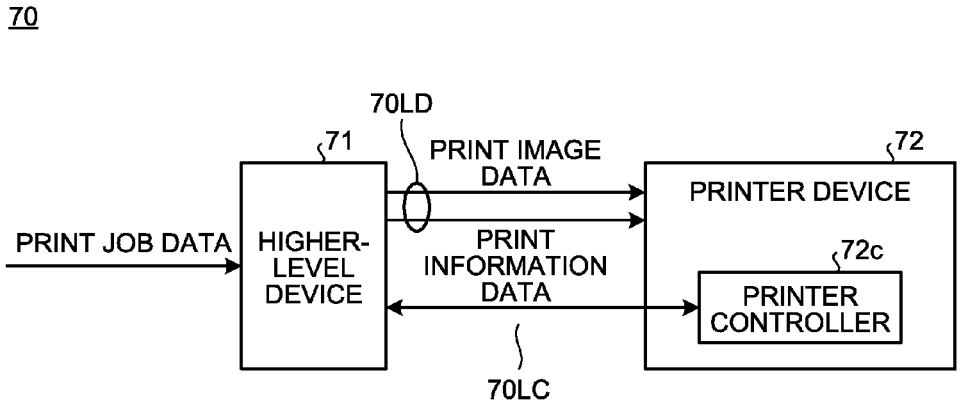
FIGS. 4A and 4B are block diagrams illustrating a configuration of a control unit configured to control the image forming apparatus in FIG. 1.
Figure 4B:
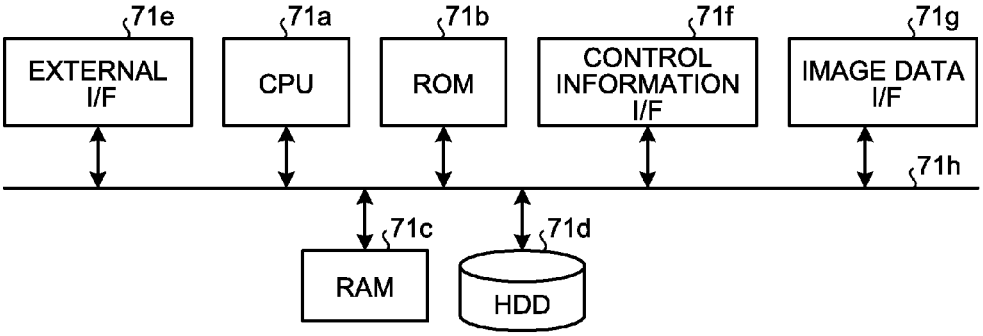

If a large pressure acts on the rolled paper Md when the rolled paper Md is wound around the storage roll in the storage unit 61, another drying unit configured to further dry the rolled paper Md immediately before the rolled paper Md is wound may be provided in order to prevent another image from being transferred on the back surface of the rolled paper Md. As illustrated in FIGS. 4A and 4B, the image forming apparatus 100 includes a control unit 70 configured to control the operation of the image forming apparatus 100.

Specifically, the image forming apparatus 100 is configured such that an image is formed on the front surface of the rolled paper Md carried in by the carry-in unit 10 and the posttreatment unit 50 executes posttreatment on the rolled paper Md having the image formed thereon. The drying unit 30 dries the post-treated rolled paper Md, and the discharge unit 60 winds the rolled paper Md, so that the rolled paper Md is ready to be discharged from the image forming apparatus 100.

Figure 2:
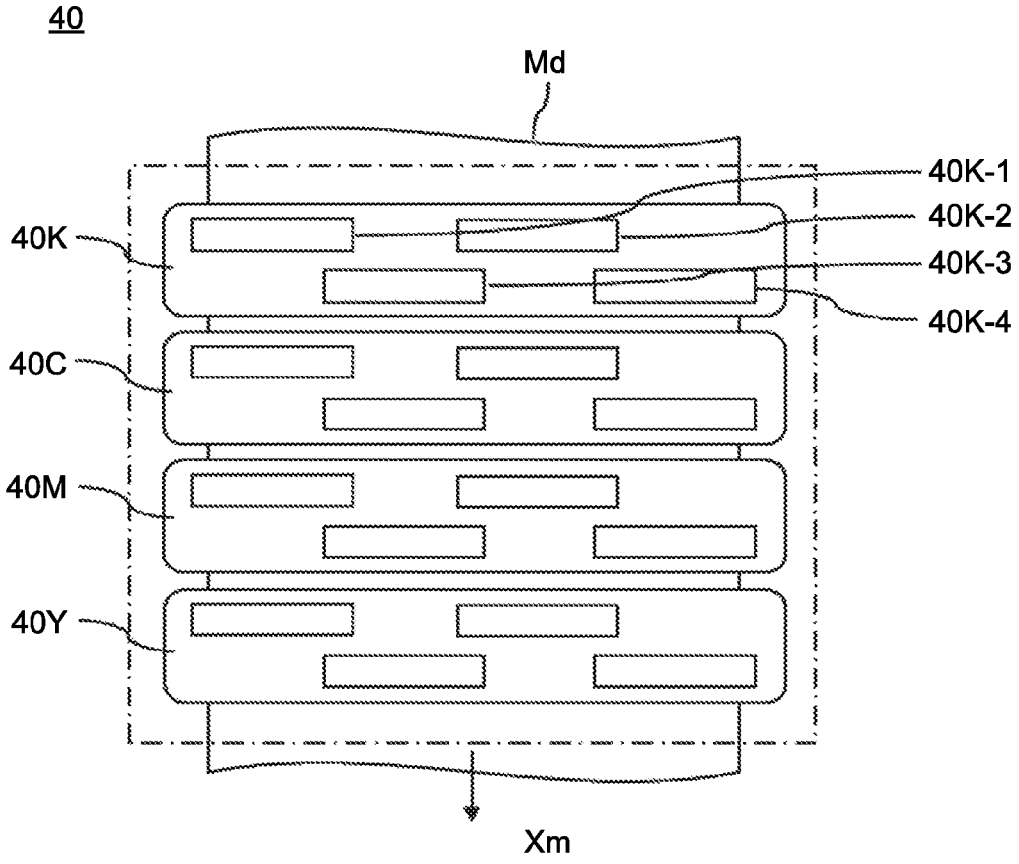
FIG. 2 is a plan view illustrating a relation between ejection heads in an image forming unit and rolled paper in the image forming apparatus in FIG. 1.

FIG. 2 is a plan view illustrating the relation between the ejection heads 40K, 40C, 40M, and 40Y in the image forming unit 40 and the rolled paper Md. FIG. 2 exemplifies the full-line type ejection heads 40K, 40C, 40M, and 40Y.

As illustrated in FIG. 2, the image forming unit 40 includes ejection heads 40K, 40C, 40M, and 40Y arranged in the order of black (K), cyan (C), magenta (M), and yellow (Y) from the upstream side in the conveyance direction Xm of the rolled paper Md. The present embodiment exemplifies the arrangement order of K, C, M, and Y, but the arrangement order is not limited thereto. For example, the arrangement order of colors may be Y, M, C, and K. A combination of colors is not limited to K, C, M, and Y, and three colors of green (G), red (R), and light cyan (LC) may be selected. A single color of black (K) may be selected rather than a combination of colors.

A first ejection head 40K-1, a second ejection head 40K-2, a third ejection head 40K-3, and a fourth ejection head 40K-4 are arranged in the ejection head 40K for black (K) in a staggered pattern in the direction orthogonal to the conveyance direction Xm of the rolled paper Md.

The staggered arrangement of the first ejection head 40K-1, the second ejection head 40K-2, the third ejection head 40K-3, and the fourth ejection head 40K-4 enables the image forming unit 40 to form an image in the entire image forming region in the width direction, that is, in the direction orthogonal to the conveyance direction Xm of the rolled paper Md.

The respective ejection heads for K, C, M, and Y have the same configuration, and hence the ejection head 40K for black (K) is taken as an example to omit the description of the ejection heads 40C, 40M, and 40Y.

Figure 3:
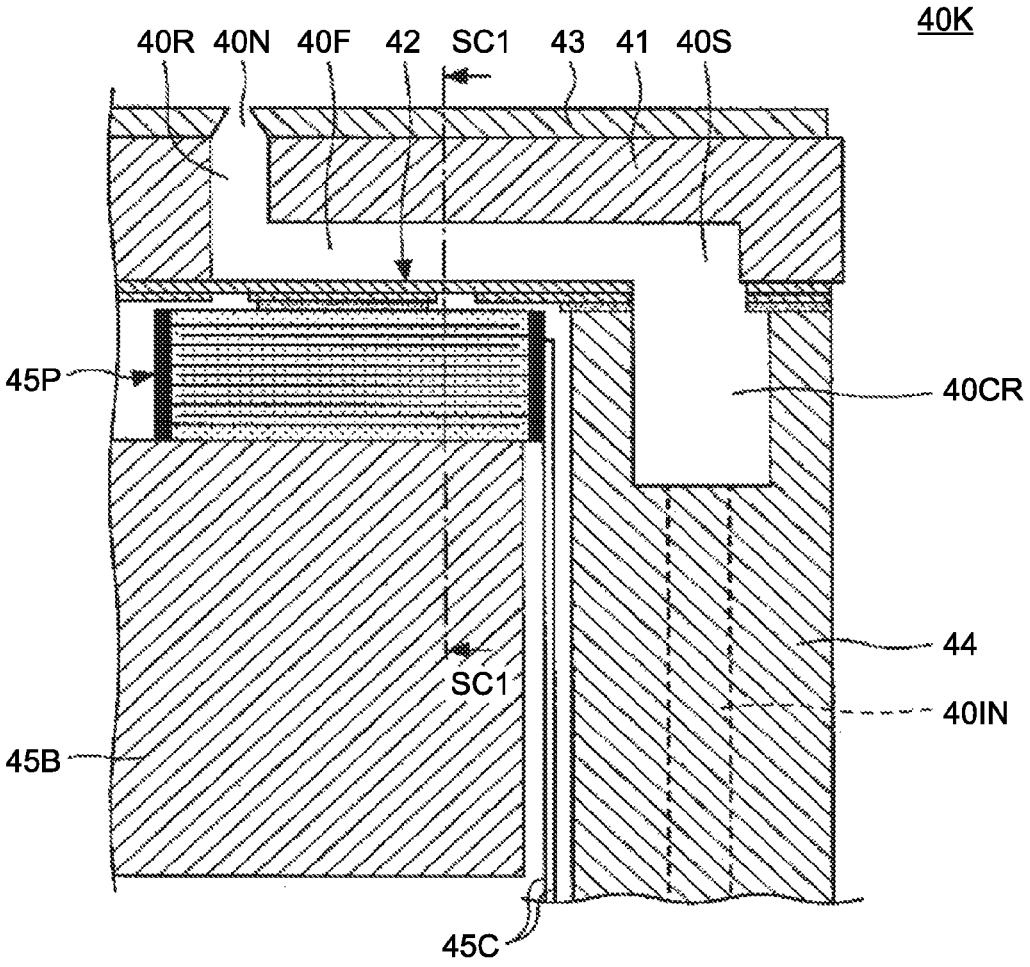
FIG. 3 is a cross-sectional view illustrating a schematic configuration of the ejection head in FIG. 2.

FIG. 3 is a cross-sectional view illustrating a schematic configuration of the ejection head 40K. The ejection head 40K includes a flow path plate 41, a diaphragm 42, a nozzle plate 43, a frame member 44, and a pressure generation unit.

The flow path plate 41 forms a path for ink to be ejected. For example, the flow path plate 41 is formed of a monocrystalline silicon substrate having a crystal plane orientation (110). The flow path plate 41 is subjected to anisotropic etching using alkaline etchant, such as a potassium hydroxide (KOH) aqueous solution, to form a recessed portion and a hole portion that serve as a nozzle communication path 40R and a liquid chamber 40F. The material that can be used for the flow path plate 41 is not limited to a monocrystalline silicon substrate. For example, the material of the flow path plate 41 may be stainless steel, a photosensitive resin, or other materials.

For example, the diaphragm 42 is formed of a metal plate processed by nickel electroforming (such as electroforming and electrocasting). The diaphragm 42 may be a metal plate formed of a material other than nickel or a member obtained by bonding metal and a resin plate. The diaphragm 42 is bonded onto the bottom surface of the flow path plate 41, that is, in the inward direction of the ejection head 40K. The diaphragm 42 is applied with force from the pressure generation unit to be deformed.

The nozzle plate 43 is formed of, for example, a monocrystalline silicon substrate. The nozzle plate 43 is processed by anisotropic etching similarly to the flow path plate 41. The nozzle plate 43 may be obtained by forming a water-repellent layer on an external surface configured by a metal member through a necessary layer. The nozzle plate 43 is bonded onto the top surface of the flow path plate 41, that is, in the outward direction of the ejection head 40K.

The nozzle plate 43 includes a plurality of nozzles 40N configured to eject ink droplets. Specifically, the nozzles 40N having a diameter of 10 μm to 30 μm are formed in the nozzle plate 43 correspondingly to each liquid chamber 40F.

The frame member 44 is formed of a thermosetting resin such as an epoxy resin or polyphenylenesulfide (PPS). Another resin having similar characteristics may be used for the material of the frame member 44. The frame member 44 includes a housing portion configured to store the pressure generation unit therein, a recessed portion serving as a common liquid chamber 40CR, and an ink supply port 40IN configured to supply ink to the common liquid chamber 40CR from outside the ejection head. The frame member 44 is processed by injection molding. The frame member 44 holds a peripheral part of the diaphragm 42.

The pressure generation unit includes a piezoelectric element 45P, a base substrate 45B that bonds and fixes the piezoelectric element 45P, and a pillar portion disposed in a gap between adjacent piezoelectric elements 45P. The pressure generation unit is connected with a flexible printed circuit (FPC) cable 45C that connects the piezoelectric element 45P to a drive circuit. As the piezoelectric element 45P, for example, a laminated piezoelectric element (PZT) obtained by alternately laminating piezoelectric materials and internal electrodes is used. The internal electrode includes a plurality of individual electrodes and a plurality of common electrodes. The individual electrodes and the common electrodes are alternately connected to the end surface of the piezoelectric element.

The piezoelectric direction of the piezoelectric element 45P is, for example, a d33 direction in which the length of a crystalline body of the piezoelectric element 45P is increased when an electric field parallel to the polarization direction is applied to the crystalline body. The pressure generation unit pressurizes or depressurizes ink inside the liquid chamber 40F in the d33 direction of the piezoelectric element 45P using the piezoelectric effect. The piezoelectric direction of the piezoelectric element 45P may be set such that ink inside the liquid chamber 40F is pressurized or depressurized in a d31 direction. The pressure generation unit may have piezoelectric elements arranged in a row for each nozzle 40N serving as an ink ejection port.

The pillar portion may be formed at the same time as the piezoelectric element 45P serving as a piezoelectric element member by dividing the piezoelectric element 45P. Specifically, the ejection head 40K may use the piezoelectric element member as the pillar portion by applying no voltage to the piezoelectric element 45P.

Pull ejection or push ejection, which is an operation of the ejection head 40K for ejecting ink from the nozzles 40N, is specifically described.

Figure 5:
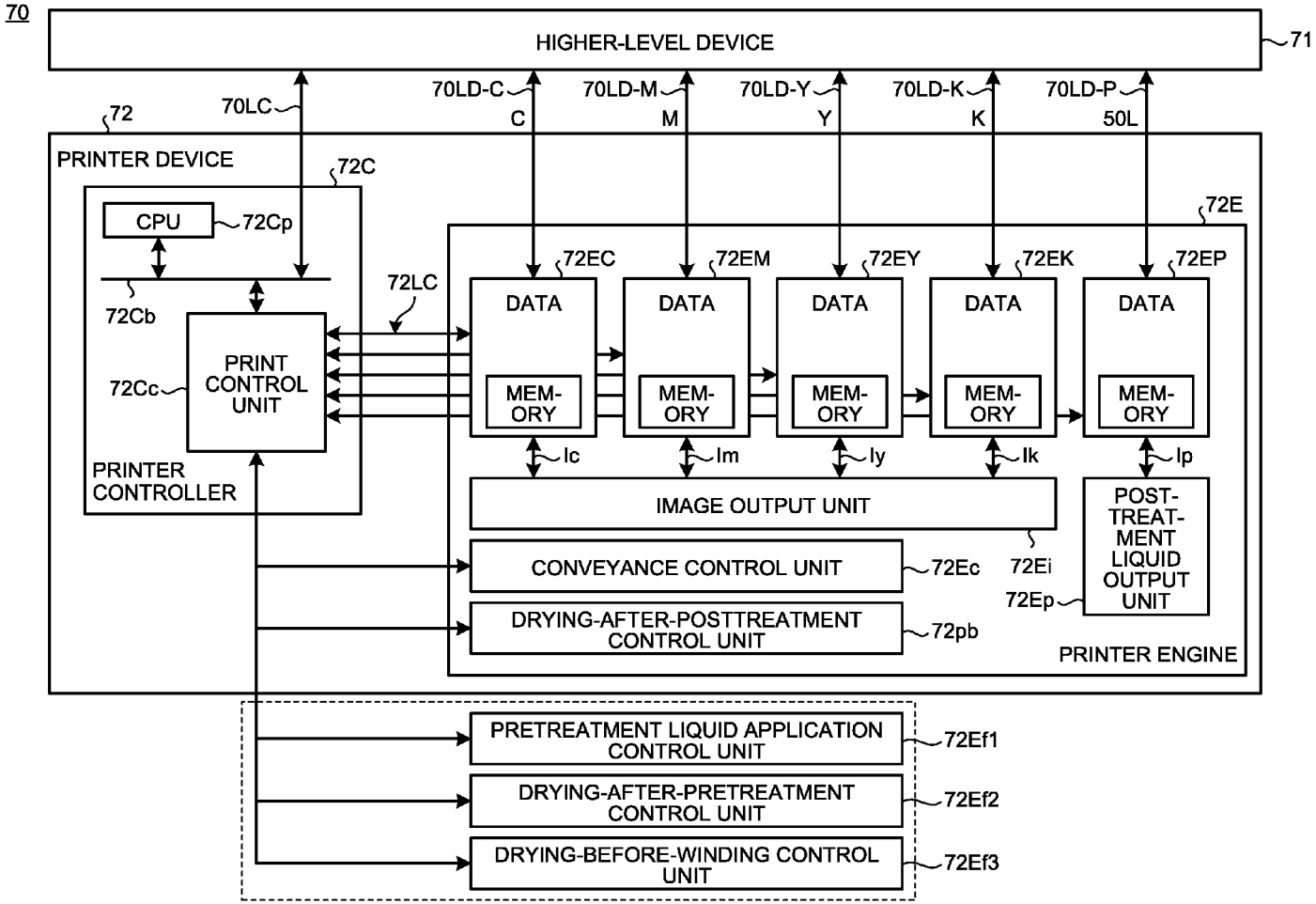
FIG. 5 is a functional block diagram illustrating a functional configuration of the control unit in FIG. 4.

A print control unit 72Cc in a printer controller 72*c* illustrated in FIG. 5 decreases a voltage applied to the piezoelectric element 45P from a reference potential to contract the piezoelectric element 45P in the lamination direction thereof so that the diaphragm 42 is warped and deformed due to the contraction of the piezoelectric element 45P. The warped and deformed diaphragm 42 increases the volume of the liquid chamber 40F. Accordingly, ink flows into the liquid chamber 40F from the common liquid chamber 40CR.

Next, the print control unit 72Cc increases the voltage applied to the piezoelectric element 45P to elongate the piezoelectric element 45P in the lamination direction thereof so that the diaphragm 42 is deformed in the direction of the nozzles 40N due to the elongation of the piezoelectric element 45P. The deformed diaphragm 42 reduces the volume of the liquid chamber 40F. Accordingly, the ink in the liquid chamber 40F is applied with pressure, and the ink is ejected from the nozzles 40N due to the pressurization of the ink.

Thereafter, the print control unit 72Cc executes a restore operation for returning the voltage applied to the piezoelectric element 45P to the reference potential so that the diaphragm 42 is returned to its original position. In the ejection head 40K, the liquid chamber 40F is depressurized due to the expansion of the liquid chamber 40F, and the liquid chamber 40F is filled with ink from the common liquid chamber 40CR. Subsequently, the vibration of meniscus in the nozzles 40N attenuates, and then the operation shifts to the next ink ejection operation. The ejection operation is repeated in this manner.

The method of driving the ejection head 40K is not limited to the pull ejection or push ejection. Pull ejection or push ejection may also be performed by controlling a voltage applied to the piezoelectric element 45P (hereinafter referred to as "drive waveform").

The print control unit 72Cc can control the force or pressure of the piezoelectric element 45P to be applied to ink, thereby controlling flushing operation and fine driving for discharging thickened ink. Flushing is classified into preprinting flushing performed immediately before printing, line flushing in which ink is ejected on the rolled paper Md all at once upon the finish of each page during printing, and star flushing in which ink is ejected in an image forming region in an unnoticeable manner.

"Page" as used in the present embodiment indicates a unit of a group of image data. For example, "page" is a unit that is cut by processing after printing.

Specifically, line flushing is processing of ejecting ink at a location not to be used for a user as a printed object. For another example, line flushing is processing of ejecting ink in the range outside input image data. In contrast, star flushing is processing of ejecting ink in an unnoticeable manner in addition to ejecting on the basis of image data within the range corresponding to input image data.

Fine driving is, for example, an operation of applying a pressure to the liquid chamber 40F by the piezoelectric element 45P to vibrate ink inside the liquid chamber 40F, thereby preventing the viscosity of ink on the surface of the meniscus from being increased due to the evaporation and drying of the ink from the surface of the meniscus. The fine driving is controlled by the pulse amplitude, period, and width and the number of pulses. The print control unit 72Cc stirs ink in such a range that the ink is not ejected from the ejection head 40K. For the fine driving, an upper limit may be set for the pulse amplitude, period, or width, the number of pulses, or the number of pulses per unit time.

The pressure generation unit according to the present embodiment is not limited to the piezoelectric element 45P. Publicly known technology, such as a thermal method or an electrostatic method, can be employed. The thermal method is a method in which a heat generating resistor is used to heat ink in the liquid chamber 40F and generate air bubbles. The electrostatic method is a method in which a diaphragm and an electrode are arranged on wall surfaces of the liquid chamber 40F so as to be opposed to each other, and the diaphragm is deformed by electrostatic force generated between the diaphragm and the electrode.

The image forming apparatus 100 according to the present embodiment uses the ejection heads 40K, 40C, 40M, and 40Y described above to perform the operation of conveying the rolled paper Md, thereby being capable of forming a full-color image or a monochrome image in the entire image forming region.

FIGS. 4A and 4B are block diagrams illustrating a configuration of the control unit 70 configured to control the image forming apparatus 100. FIG. 4A illustrates the configuration of the control unit 70, and FIG. 4B illustrates a hardware configuration of a higher-level device 71 included in the control unit 70. A printer device 72 is configured by the same hardware as in the higher-level device 71.

As illustrated in FIG. 4A, the control unit 70 makes an operation instruction to each component in the image forming apparatus 100, and controls the operation. The control unit 70 includes the higher-level device 71 and the printer device 72. In the present embodiment, the higher-level device 71 is a digital front end (DFE), and performs raster image processor (RIP) processing. The printer device 72 performs print processing and other processing. The higher-level device 71 and the printer device 72 are communicably connected to each other via a plurality of data lines 70LD and a control line 70LC.

As illustrated in FIG. 4B, the higher-level device 71 includes a central processing unit (CPU) 71*a*, a read only memory (ROM) 71*b*, and a random access memory (RAM) 71*c*. The higher-level device 71 further includes a hard disk drive (HDD) 71*d*, an external I/F 71*e*, a control information I/F 71*f*, and an image data I/F 71*g*. The devices included in the higher-level device 71, such as the CPU 71*a*, are connected to one another by a bus 71*h*. In other words, the higher-level device 71 is configured to be capable of transmitting and receiving information to and from the connected devices such as the CPU 71*a* via the bus 71*h*.

The higher-level device 71 performs RIP processing as described above on the basis of print job data, such as job data and print data, output from a host device.

Specifically, the higher-level device 71 generates image data for printing (hereinafter referred to as "print image data") such as bitmap data corresponding to each color of CMYK on the basis of the print job data. The print image data may include data related to the ejection of posttreatment liquid to be ejected by the posttreatment unit 50 (hereinafter referred to as "posttreatment-related image data").

The higher-level device 71 generates, on the basis of the print job data, information from the host device, and others, data for controlling the print operation (hereinafter referred to as "control information data"). The control information data includes data related to print conditions such as print form, print type, paper feeding/ejection information, print side order, print sheet size, data size of print image data, resolution, paper type information, gradation, color information, and number of pages to be printed. The control information data may further include data related to the ejection of posttreatment liquid to be ejected by the posttreatment unit 50 (hereinafter referred to as "posttreatment-related control data").

The CPU 71*a* controls the overall operation of the higher-level device 71. The CPU 71*a* controls the operation of the higher-level device 71 using a computer program stored in the ROM 71*b* or the HDD 71*d*. The ROM 71*b*, the RAM 71*c*, and the HDD 71*d* store data or computer programs therein. A control program for controlling the CPU 71*a* is stored in the ROM 71*b* or the HDD 71*d*. The RAM 71*c* is used as a work memory configured to expand the computer program used by the CPU 71*a* or intermediate data.

The external I/F 71*e* is used for communication between the image forming apparatus 100 and an external device such as the host device. For example, the external I/F 71*e* is used for communication compatible with the Transmission Control Protocol/Internet Protocol (TCP/IP). The control information I/F 71*f* is used for communication of the control information data. For example, the control information I/F 71*f* is Peripheral Component Interconnect Bus Express (PCI Express). The control information I/F 71*f* may be PCI or Industry Standard Architecture (ISA).

The image data I/F 71*g* is used for communication of the print image data. For example, the image data I/F 71*g* is PCI Express. The image data I/F 71*g* may be PCI or ISA. In the present embodiment, the image data I/F 71*g* has a plurality of channels corresponding to respective colors of print image data.

The higher-level device 71 receives print job data transmitted from an external device such as the host device with the external I/F 71*e* under control of the CPU 71*a*, and stores the print job data in the HDD 71*d*. The CPU 71*a* generates bitmap data for each color of CMYK on the basis of the stored print job data, and stores the generated bitmap data for each color in the RAM 71*c*. For example, the higher-level device 71 performs, as RIP processing, processing of rendering a page description language (PDL) to generate bitmap data for each color of CMYK and writing the bitmap data on the RAM 71*c*.

Specifically, the higher-level device 71 executes the processing of:

- compressing and encoding bitmap data for each color written on the RAM 71*c*, and storing the bitmap data in the HDD 71*d;*
- reading, upon the start of print operation in the printer device 72 described later, the encoded bitmap data for each color from the HDD 71*d*, and decoding the bitmap data and writing the resultant bitmap data for each color in the RAM 71*c;*
- reading the bitmap data for each color from the RAM 71*c*, and outputting the read bitmap data to the printer device 72 described later via print image data for each color via each channel of the image data I/F 71*g;* outputting the print image data to the printer device 72 described later via the data line 70LD in FIG. 4A as each channel of the image data I/F 71*g;* transmitting and receiving control information data to and from the printer device 72 described later via the control information I/F 71*f* and the control line 70LC in accordance with the progress of the printing operation; and reading, upon the start of posttreatment in the printer device 72 described later, encoded posttreatment-related image data from the HDD 71*d*, and outputting the image data to the printer device 72 described later via the data line in FIG. 4A similarly to the bitmap data.

The printer device 72 sets the conditions for flushing operation on the basis of the types of recording medium and ink, the recording resolution, the conveyance speed, the image sheet length, or temperature and humidity. In regard to the method of setting the conditions for the flushing operation, for example, a condition table as illustrated in FIG. 6 having a combination of the number of line flushing droplets as the number of first flushing droplets and the number of star flushing droplets as the number of second flushing droplets is registered in the printer device 72 in advance.

The printer device 72 is configured such that the conditions for flushing operation are extracted on the basis of the types of recording medium and ink, the recording resolution, the conveyance speed, the image sheet length, or the temperature and humidity and configured such that a condition table as illustrated in FIG. 6 registered in the printer device 72 in advance is manually set.

The image formation period for one printing may be extremely long depending on users. Thus, constrains may be provided for the flushing operation, and the flushing operation may be automatically set within this range. The flushing operation as used herein means flushing with a combination of star flushing and line flushing. Flushing conditions mean control conditions for the flushing operation.

FIG. 5 is a functional block diagram of the control unit 70 according to the present embodiment. In FIG. 5, the control unit 70 includes the higher-level device 71 and the printer device 72. The printer device 72 controls the operation of forming an image on the rolled paper Md on the basis of print image data and control information data input from the higher-level device 71. The printer device 72 includes the printer controller 72*c* and a printer engine 72E.

The printer controller 72*c* includes a CPU 72Cp and a print control unit 72Cc, and the CPU 72Cp and the print control unit 72Cc are connected to each other via a bus 72Cb so as to transmit and receive information therebetween. The bus 72Cb is connected to the control line 70LC via a communication I/F. The CPU 72Cp controls the overall operation of the printer device 72 using a control program stored in the ROM in the printer device 72.

The print control unit 72Cc transmits and receives information such as commands, parameters, and data to and from the printer engine 72E on the basis of the control information data transmitted from the higher-level device 71. The print control unit 72Cc controls the printer engine 72E by transmitting and receiving information to and from the printer engine 72E.

The printer controller 72*c* controls the printer engine 72E. The printer controller 72*c* transmits and receives control information data to and from the higher-level device 71 via the control line 70LC. The printer controller 72*c* transmits and receives control information data to and from the printer engine 72E described later via a control line 72LC.

The printer controller 72*c* writes printing conditions included in the transmitted/received control information data in a register of the print control unit 72Cc, and stores the printing conditions in the register. The printer controller 72*c* controls the printer engine 72E on the basis of the control information data, and executes printing in accordance with the print job data and the control information data.

The printer engine 72E includes a conveyance control unit 72Ec, an image output unit 72Ei, a posttreatment liquid output unit 72Ep, a drying-after-posttreatment control unit 72*pb*, and a plurality of data management units 72EC, 72EM, 72EY, 72EK, and 72EP. The conveyance control unit 72Ec controls conveyance speed of the rolled paper Md. The image output unit 72Ei receives print image data from the data management units 72EC, 72EM, 72EY, and 72EK, and performs image formation output for forming an image on the rolled paper Md.

The printer engine 72E converts bitmap data input from the higher-level device 71 into less-valued data corresponding to the image formation output on the basis of an instruction from the printer controller 72*c*, and divides the resultant data for each of the ejection head 40C, the ejection head 40M, the ejection head 40Y, and the ejection head 40K. For example, the printer engine 72E converts input 256-bit bitmap data into quadrature values of large droplet, medium droplet, small droplet, and fine driving, and divides the resultant data into data for the corresponding ejection head 40C, ejection head 40M, ejection head 40Y, and ejection head 40K.

The printer engine 72E is connected with a plurality of data lines TOLD-Y, TOLD-C, TOLD-M, TOLD-K, and TOLD-P, and receives print image data from the higher-level device 71. The posttreatment liquid output unit 72Ep receives posttreatment-related data from the data management unit 72EP, and performs posttreatment.

The printer engine 72E includes, as indicated by the broken line, a pretreatment liquid application control unit 72Ef1, a drying-after-pretreatment control unit 72Ef2, or a drying-before-winding control unit 72Ef3, for example. The pretreatment liquid application control unit 72Ef1 and the drying-after-pretreatment control unit 72Ef2 are necessary when a pretreatment liquid application unit and an after-pretreatment drying unit are placed between the carry-in unit 10 and the image forming unit 40 or when a before-winding drying unit configured to dry the rolled paper Md immediately before the rolled paper Md is wound by the discharge unit 60 is placed.

With the configuration described above, the printer engine 72E has the functions of:

forming an image of each color of CMYK on rolled paper Md on the basis of print image data input from the higher-level device 71 and control information data input from the printer controller 72*c*; and executing posttreatment on the basis of posttreatment-related image data in the print image data input from the higher-level device 71 and posttreatment-related control data in the control information data input from the printer controller 72*c*.

Next, the flushing operation according to the present embodiment is described in detail with reference to the accompanying drawings. FIGS. 6 to 9C are explanatory diagrams illustrating a list of control condition tables for the flushing operation. FIG. 6 is a flushing operation selection condition table. FIG. 7 includes diagrams illustrating a list of mask table condition tables. FIGS. 8A to 8C are diagrams illustrating a mask table determination method. FIGS. 9A to 9C are diagrams illustrating a selectable flushing operation determination method.

Control of the flushing operation can be automatically set from various kinds of printing conditions as described later, but the flushing operation can be manually selected as well. For the manual selection, an access is made to the printer controller 72*c* from an input device. In the following description related to FIG. 6 to FIGS. 9A to 9C, the case where a user selects automatic selection of the flushing condition is described.

FIG. 6 is a table of information representing a relation between star flushing and line flushing that can be selected as flushing operation. The vertical axis represents the number of line flushing droplets, and the horizontal axis represents the number of star flushing droplets. A matrix from $D_{11}$ to $D_{nm}$ is information representing the number of droplets used when line flushing and star flushing are combined. When flushing operation is manually selected, flushing operation can be freely selected from this table.

When flushing operation is automatically controlled or when the range that can be manually selected is limited, the table illustrated in FIG. 6 needs to be masked as illustrated in FIGS. 9A to 9C in accordance with each printing condition. One mask table is uniquely determined for each of the printing conditions indicated by mask table condition tables in FIG. 7. In the present embodiment, associating unavailable information with a table stored in a non-volatile storage medium such as the HDD 71*d* is referred to as "masking the table".

For example, when the recording medium in the image forming apparatus 100 is plain paper and ink that is less volatile is used, a mask table $T_{n2}$ illustrated in FIG. 8A is selected from the mask tables illustrated in FIG. 7 for the type of recording medium (condition 1) and a mask table $T_{1n}$ illustrated in FIG. 8B is selected from the mask tables illustrated in FIG. 7 for the type of ink (condition 2), and are combined.

In this case, the respective mask tables are combined to obtain a mask table $T_{n2}+T_{1n}$ as illustrated in FIG. 8C representing the relation between star flushing and line flushing. A table in FIG. 9A is masked with a mask table $T_{n2}+T_{1n}$ illustrated in FIG. 9B to determine the selectable flushing operations.

In FIGS. 8A to 8C and FIGS. 9A to 9C, selectable flushing operations are indicated by ○. When the table illustrated in FIG. 9A is masked with the mask table $T_{n2}+T_{1n}$ illustrated in FIG. 9B, a matrix of locations marked with ○ in the mask table $T_{n2}+T_{1n}$ illustrated in FIG. 9B indicates the number of star flushing droplets and the number of line flushing droplets that can be selected under any conditions.

In contrast, even when the selectable flushing operations are presented, there may be a plurality of options as illustrated in FIG. 9C. In this case, a user can freely select the flushing operation, but it is preferred to select a condition that the minimum amount of flushing is executed and the waste ink amount is reduced.

In the case of discharging thickened ink when ink that is more volatile is used in the image forming apparatus 100, the thickened ink remains to cause abnormal landing of ink at the end of the image forming region unless line flushing is performed with a larger number of droplets. Similarly to line flushing, star flushing also needs to be performed with a larger number of droplets in order to reduce the residual of thickened ink.

In contrast, in the case of discharging thickened ink when ink that is less volatile is used in the image forming apparatus 100, ink is wastefully consumed unless line flushing is performed with a smaller number of droplets. Star flushing needs to be performed with a smaller number of droplets so that scumming is less conspicuous on coated paper.

If star flushing has an output of droplets smaller than small droplets or star flushing has an output of droplets larger than large droplets, the printer engine 72E adds data on values corresponding to star flushing and line flushing to obtain 6-value data. The number of values is an example, and is not limited to four and six.

Thus, after the selectable flushing operations are determined, a flushing operation that can reduce the waste ink amount most among the selectable flushing operations is fed back to execute a job. Control of feeding back temperature and humidity conditions measured at S1113 may be replaced with adjustment of a temperature/humidity mask table to a selected mask to select flushing conditions.

Figure 10:
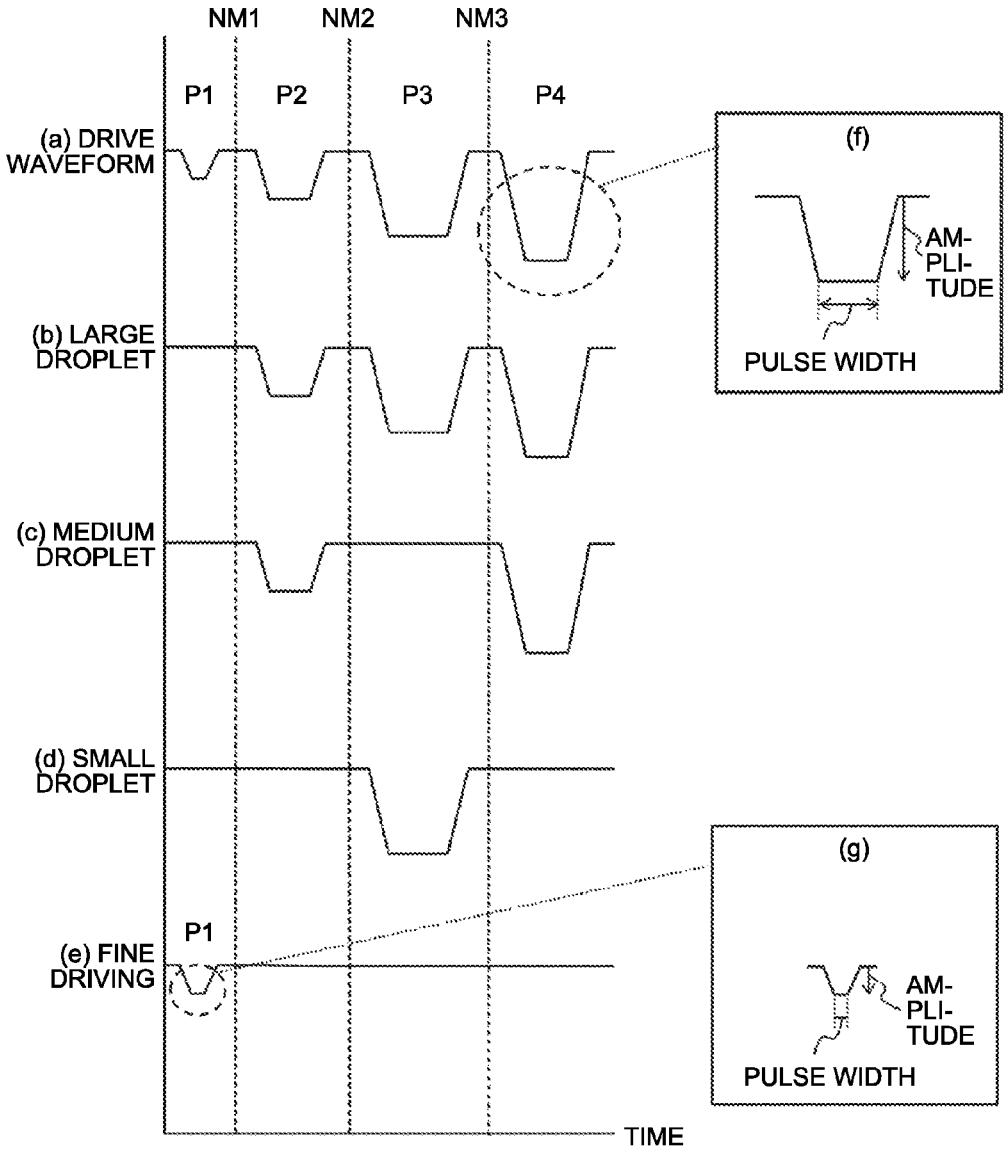
FIG. 10 is an explanatory diagram illustrating a relation between a drive waveform output from the control unit in FIGS. 4A and 4B and ink droplet ejection control and fine driving control.

The printer controller 72*c* controls the piezoelectric element 45P to control the ejection of ink, the flushing, and the fine driving. The piezoelectric element 45P is controlled to be driven by a drive waveform as a control signal. FIG. 10 is an explanatory diagram illustrating a relation between the drive waveform output from the printer controller 72*c* and ink droplet ejection control and fine driving control. In FIG. 10, the horizontal axis represents time, and the vertical axis represents the amplitude of waveforms.

The operation is described for each of four values, that is, large droplet ejection of ejecting ink in a large amount from the ejection head 40K, medium droplet ejection of ejecting ink in an amount smaller than of large droplets and larger than of small droplets, small droplet ejection of ejecting ink in a small amount, and fine driving. Specifically, in the present embodiment, for example, the drive waveform (a) is masked to form four kinds of waveforms for large droplets, medium droplets, small droplets, and fine driving. In the fine driving, ink is not ejected because the fine driving is the operation of stirring ink in the range where ink is not ejected from the ejection head 40K as described above.

FIG. 10 illustrates an example of the drive waveform at (a). For example, the drive waveform includes a first use waveform P1, a second use waveform P2, a third use waveform P3, and a fourth use waveform P4. The piezoelectric element 45P is controlled on the basis of each factor of the first use waveform P1, the second use waveform P2, the third use waveform P3, and the fourth use waveform P4 masked from the drive waveform. Voltage values of the drive waveform in all combinations of the first use waveform P1, the second use waveform P2, the third use waveform P3, and the fourth use waveform P4 are stored in a non-volatile storage medium such as the HDD 71*d*. A mask signal corresponding to which part of the first use waveform P1, the second use waveform P2, the third use waveform P3, and the fourth use waveform P4 is to be masked is generated on the basis of image data generated by the printer engine 72E.

FIG. 10 illustrates a waveform generated by masking a part of the drive waveform until the time NM1 at (b). As illustrated at (b) in FIG. 10, when the second use waveform P2, the third use waveform P3, and the fourth use waveform P4 are input, the piezoelectric element 45P operates to eject a large droplet whose ink amount is large. In this case, the piezoelectric element 45P applies ink with pressure that is so high that the large droplet set in advance can be ejected.

FIG. 10 illustrates a waveform generated by masking a part of the drive waveform until the time NM1 and a part of the drive waveform from the time NM2 to the time NM3 at (c). As illustrated at (c) in FIG. 10, when the second use waveform P2 and the fourth use waveform P4 are input, the piezoelectric element 45P operates to eject a medium droplet whose ink amount is smaller than the large droplet and larger than a small droplet. In this case, the piezoelectric element 45P applies ink with pressure that is so high that the medium droplet set in advance can be ejected.

FIG. 10 illustrates a waveform generated by masking a part of the drive waveform until the time NM2 and a part of the drive waveform after the time NM3 at (d). As illustrated at (d) in FIG. 10, when the third use waveform P3 is input, the piezoelectric element 45P operates to eject a small droplet whose ink amount is small. In this case, the piezoelectric element 45P applies ink with pressure that is so low that the small droplet set in advance can be ejected.

FIG. 10 illustrates a waveform generated by masking a part of the drive waveform after the time NM1 at (e). As illustrated at (e) in FIG. 10, when the first use waveform P1 is input, the piezoelectric element 45P performs fine driving.

As illustrated at (f) in FIG. 10, the ejection amount of ink is controlled by the amplitude of the waveform input to the piezoelectric element 45P. For example, the amplitude input to the piezoelectric element 45P is increased in order to increase the amount of ink to be ejected, and the amplitude input to the piezoelectric element 45P is decreased in order to reduce the amount of ink to be ejected. In the case of fine driving, as illustrated at (g) in FIG. 10, the pulse width and amplitude of the first use waveform P1 input to the piezoelectric element 45P are smaller than of the fourth use waveform P4. In the present embodiment, the ejection amount of ink is controlled by the control of the amplitude of the waveform input to the piezoelectric element 45P, but the ejection amount of ink may be controlled using another means.

The amplitude value of the waveform input to the piezoelectric element 45P during the fine driving (fine driving peak value) has conditions suitable for the non-ejection period. For example, when the non-ejection period is long, the amplitude value of the waveform input to the piezoelectric element 45P is reduced in order to reduce the amount of flushing droplets. In contrast, when the non-ejection period is shorter, the amplitude value of the waveform input to the piezoelectric element 45P can be increased to reduce the amount of flushing droplets.

For example, when star flushing is selected as main flushing means, ink is ejected during printing. In this case, the non-ejection period is shorter than when star flushing is not performed. It is therefore sufficient if the amplitude value of the waveform input to the piezoelectric element 45P is reduced to execute fine driving.

In contrast, when line flushing is selected as main flushing means, the non-ejection period is longer than the case of star flushing. It is therefore desired to increase the amplitude value of the waveform input to the piezoelectric element 45P to execute fine driving. When the non-ejection period is equal to or more than a given period of time, control may be performed to increase the amplitude value of the waveform input to the piezoelectric element 45P only immediately before the ejection to execute fine driving.

As the suitable conditions, for example, the relation between the amplitude value of the waveform input to the piezoelectric element 45P in the fine driving and the non-ejection period may be measured in advance by a real machine and converted into a table, and the printer controller 72*c* may select a suitable amplitude value from the table on the basis of the non-ejection period. For another example, when the relation between the amplitude value of the waveform input to the piezoelectric element 45P in the fine driving and the non-ejection period is definite, the printer controller 72*c* may select suitable conditions on the basis of the relation.

The printer controller 72*c* may calculate the amplitude value of the waveform input to the piezoelectric element 45P on the basis of the non-ejection period using a mathematical expression serving as a characteristic graph indicated by a table of the relation between the amplitude value of the waveform input to the piezoelectric element 45P in the fine driving and the non-ejection period, which is a value measured in advance by an actual machine. A plurality of mathematical expressions may be used.

The ejection speed of ink is controlled by the pulse width of the waveform illustrated at (e) in FIG. 10. The ejection speed of ink is determined in advance by ink and the ejection head 40K on the basis of consumption power or an upper limit period of the pulse width, and is set. The ejection speed of ink decreases when the ink is thickened or when a suitable pulse width is changed. It is therefore desired that the ejection speed of ink be controlled by adjusting the pulse width set in advance. The control of the ejection speed of ink is not limited to the control by the adjustment of the pulse width of the waveform, and the ejection speed of ink may be controlled by another means.

For example, the number of ejection droplets of ink is controlled by the input number of waveforms illustrated at (e) in FIG. 10. For example, when the number of large ejection droplets is set to one, the second use waveform P2 and the third use waveform P3 are input each once. The control of the number of ejection droplets of ink is not limited to the control by the input number of waveforms, and the number of droplets of ink may be controlled by another means. The number of ejection droplets of ink or the ejection amount may be controlled by the number of use waveforms input within one cycle or the conveyance speed.

For example, the pressure to be applied to ink by the fine driving is controlled by the amplitude of the waveform illustrated at (f) in FIG. 10. The control of the pressure to be applied to ink by the fine driving is not limited to the control by the amplitude of the waveform. The fine driving of the ejection head 40C may be made by another means to control the pressure to be applied to ink.

A fine driving cycle, which is a cycle during which the fine driving is executed, is controlled by a cycle during which the first use waveform P1 is input. Examples of the control of the fine driving cycle include setting the cycle to 20 kHz from 40 kHz. The control of the fine driving cycle is not limited to the control by the cycle during which the first use waveform P1 is input, and the fine driving cycle may be controlled by another means. The cycle may be controlled by the count of the fine driving per unit time. For example, the count of the fine driving is controlled by the input number of waveforms illustrated at (f) in FIG. 10. The fine driving is not performed periodically but performed once or for designated times corresponding to the input number of waveforms at desired timing. The control of the count of the fine driving is not limited to the control by the count of the waveform. The count of the fine driving may be controlled by another means.

The image forming apparatus 100 can control the flushing operation suited to the conveyance speed, thus discharging thickened ink and reducing the phenomenon of non-ejection caused by thickened ink or abnormal landing of ink.

It is desired that the flushing operation be controlled by the control of ejection speed among the control of ejection amount of ink, the control of ejection speed, and the control of the number of ejection droplets. For example, in the case of line flushing, the force of discharging ink in the flushing operation can be enhanced by increasing the ejection speed, and hence ink with high viscosity can be discharged.

In the case of a line head, flushing is performed such that the ejection amount of ink becomes a given amount or the range where ink is ejected falls within a given range, and it is therefore desired to perform flushing with the ejection amount of droplets based on the conveyance speed. Flushing, which is performed with the amount of droplets based on the conveyance speed, has sufficient flushing strength and can reduce the phenomenon of non-ejection caused by thickened ink or abnormal landing of ink.

Figure 11:
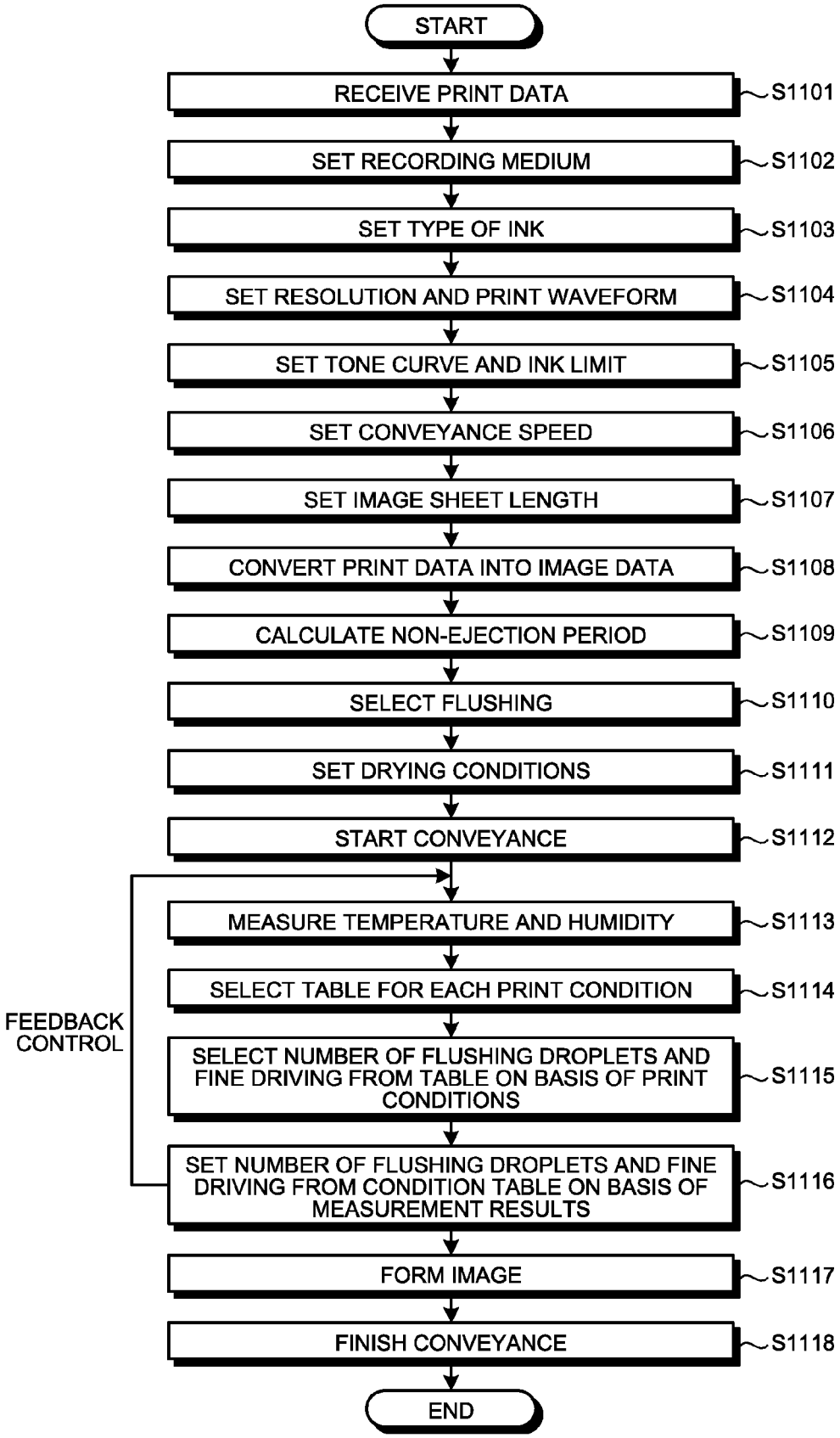
FIG. 11 is a flowchart illustrating an overall processing procedure executed by the control unit in FIGS. 4A and 4B.

Next, the flow of control of the flushing operation executed by the control unit 70 according to the present embodiment is described with reference to FIG. 11. FIG. 11 is a flowchart illustrating a processing procedure of controlling the flushing operation executed by the control unit 70 in the image forming apparatus 100 according to the present embodiment. First, the printer device 72 receives print data from the higher-level device 71 (S1101). The print data as used herein refers to the printing form, which is information in which the quality of an image to be printed is set, the image size, the color information, and the number of pages.

Next, the printer controller 72*c* sets data on a recording medium to be used, that is, the rolled paper Md (S1102). The data on the rolled paper Md is information on the thickness of the rolled paper Md, the type of recording medium, such as plain paper, inkjet paper, and ordinary coated paper, or physical properties or characteristics of the recording medium. Examples of the physical properties of the recording medium include the size, the medium material physical properties, and the thickness and weight of the medium.

When the setting of the print data and the data on the rolled paper Md is finished, the printer controller 72*c* sets the type of ink to be used (S1103), and sets the recording resolution (S1104). The printer controller 72*c* automatically selects a print waveform on the basis of the recording resolution, and determines the ejection amount of recording liquid (ink) per droplet on the basis of the print waveform. When the setting of the recording resolution has already been included in the image data received at S1101, the printer controller 72*c* sets the print waveform on the basis of the image data received at S1101.

Next, the printer controller 72*c* sets a tone curve and an ink limit (S1105). The printer controller 72*c* sets conveyance speed (S1106), and next sets the image sheet length, that is, information on recording in an image forming region in the conveyance direction Xm (image forming region recording information) (S1107). The image sheet length can be freely set irrespective of the image size. The information set at S1102 to S1107 is transmitted to the higher-level device 71 from the printer controller 72*c*.

The higher-level device 71 converts the print data into image data on the basis of the conditions set at S1102 to S1107, and transfers the converted image data to the printer device 72 (S1108). The printer controller 72*c* calculates a non-ejection period, which is the period during which ink is not ejected from the nozzles 40N, in accordance with the image data, the conveyance speed, and the image sheet length received from the higher-level device 71 (S1109). In this case, the printer device 72 calculates a non-ejection period of a nozzle 40N that is the longest non-ejection period among non-ejection periods of the nozzles 40N.

Next, the printer controller 72*c* selects a combination of the flushing means on the basis of the information set by the user. In other words, the printer controller 72*c* can receive an input of the number of star flushing droplets and an input of the number of line flushing droplets. The printer controller 72*c* can further receive setting of automatic selection of the flushing conditions. The printer controller 72*c* generates information on the conditions based on the selection by the user (S1110).

The non-ejection period in the present embodiment indicates the period during which the image forming unit 40 does not perform flushing or eject ink. The image forming apparatus 100 forms an image on the rolled paper Md. In this case, the printer controller 72*c* determines a non-printing region where no printing in accordance with the generated image data and the image sheet length, and divides the length of the non-printing region in the conveyance direction Xm by the conveyance speed to calculate the non-ejection period.

The printer controller 72*c* calculates the non-ejection period on the basis of the conveyance speed, the image sheet length, and the image data as described above. The printer controller 72*c* may calculate an interval between places where line flushing can be performed on the basis of the image sheet length, and may divide the interval by the conveyance speed to calculate the non-ejection period. For example, some image forming apparatuses 100 may be frequently input with image data for which nozzles 40N that are never used to eject ink during printing are set. In such apparatuses, by determining the non-ejection period on the basis of the interval between places where line flushing can be performed, the non-ejection period can be determined more easily and reliably.

The printer controller 72*c* selects drying conditions for the image forming apparatus 100 (S1111). Next, the conveyance control unit 72Ec starts to carry in the rolled paper Md (S1112).

The printer device 72 includes a temperature sensor and a humidity sensor configured to measure environmental temperature and humidity respectively in the vicinity of the ejection head. The printer controller 72*c* controls the temperature sensor to measure environmental temperature around the ejection head, and controls the humidity sensor to measure humidity around the ejection head (S1113).

Next, the printer controller 72*c* selects a mask table for each of non-ejection time and printing condition on the basis of the information set at S1101 to S1113 (S1114). In this case, the printer controller 72*c* determines the non-ejection period [second] as described above on the basis of the input image data and the conveyance speed of the rolled paper Md. The printer controller 72*c* specifies a mask table $T_{xy}$ on the basis of the non-ejection period and the printing conditions (such as the type and thickness of the recording medium, the drying unit 30, the type of ink, and the recording resolution). When the fixed number of droplets is manually input by a user at S1110, the processing from S1114 to S1116 is not executed, and an image is formed with the input number of flushing droplets without any further processing.

Mask tables $T_{11}$ to $T_{nn}$ each have a table with ○ and x as illustrated on the left side in FIGS. 8A to 8C. The printer controller 72*c* controls the printer engine 72E to eject ink at a location $T_{xy}$ indicated by ○. Correspondingly to FIGS. 9A to 9C, x is the number of line flushing droplets, and y is the number of star flushing droplets. The number of line flushing droplets and the number of star flushing droplets are each the number of droplets per page or for the nozzles 40N per A4 size.

For example, a mask table $T_{n2}$ illustrated in FIG. 8A is selected for the type of recording medium (condition 1) and a mask table $T_{1n}$ illustrated in FIG. 8B is selected for the type of ink (condition 2). FIG. 8C illustrates a mask table obtained by combining the mask tables. The table in FIG. 9A is masked with the mask table $T_{n2}+T_{1n}$ illustrated in FIG. 8C to determine the selectable flushing operations.

When the table illustrated in FIG. 9A is masked with the mask table $T_{n2}+T_{1n}$ illustrated in FIG. 8C, a matrix of locations marked with ○ in the mask table $T_{n2}+T_{1n}$ illustrated in FIG. 8C indicates the number of star flushing droplets and the number of line flushing droplets that can be selected under any conditions.

Next, the printer controller 72*c* selects the number of flushing droplets from printing conditions on the basis of the flushing operation information selected at S1110 (S1115).

The printer controller 72*c* receives the temperature information and the humidity information to set each number of flushing droplets in real time during printing, and reflects the set numbers of flushing droplets to a print job executed at S1117 (S1116).

Next, the printer controller 72*c* transmits the determined number of line flushing droplets and the determined number of star flushing droplets to the printer engine 72E. The printer engine 72E arranges data for star flushing such that star flushing is irregularly formed on an image of bitmap data received from the higher-level device 71, and arranges data for line flushing. Thereafter, the image output unit 72Ei outputs data obtained by combining the data for star flushing and the data for line flushing (S1117).

The printer controller 72*c* controls the sensors to measure temperature information and humidity information when the print job is executed. The printer controller 72*c* executes control of feeding the measurement result back to the processing executed at S1113. The printer controller 72*c* discharges the formed image (S1118), and finishes the job. In the present processing, the printer controller 72*c* need not execute real-time detection with masking the real-time detection when it takes processing time to change the flushing conditions in real time at S1113.

A larger amplitude of the waveform input to the piezoelectric element 45P results in a larger stirring effect of ink obtained by fine driving and can reduce the amount of star flushing. To increase the amount of star flushing, it is therefore sufficient if the amplitude of the waveform input to the piezoelectric element 45P is reduced, thereby reducing the stirring effect of ink obtained by fine driving.

However, when the amplitude of the waveform input to the piezoelectric element 45P is increased to execute large fine driving, the amount of ink to be brought into contact with the air is increased, and as a result, the viscosity of ink is increased. Line flushing can suppress the increase in viscosity of ink. Thus, when the number of line flushing droplets is set such that ink with increased viscosity can be ejected, the printer controller 72*c* can perform control of increasing the fine driving and reduce the number of star flushing droplets.

Thus, in the processing at S1115, the printer controller 72*c* may select each number of flushing droplets and the amplitude of fine driving from the printing conditions on the basis of the information on the flushing operation selected at S1110. In this case, the printer controller 72*c* selects the amplitude of the waveform input to the piezoelectric element 45P in order to perform fine driving on the basis of the number of line flushing droplets indicated by the mask table selected at S1114.

In the processing at S1116, the printer controller 72*c* may set each number of flushing droplets and the amplitude of fine driving in real time even during printing, and may reflect the set information to a print job executed at S1117. The processing thereafter is the same as in the steps in the flow described above with reference to FIG. 11.

The image forming apparatus 100 according to the present embodiment may use production printing as a printing system. Production printing involves efficient job management, printing data management, and others. Production printing is a manufacturing system capable of performing image formation such as printing or printing characters on a massive amount of media or printed objects in a short period of time. Specifically, the image forming apparatus 100 according to the present embodiment performs RIP processing for controlling printing operation such as bitmap data and printing processing based on the bitmap data controlled by the RIP processing with different devices.

The control unit 70 according to the present embodiment builds a workflow system configured to manage the creation of print data and the distribution of printed objects. Specifically, the control unit 70 in the image forming apparatus 100 according to the present embodiment can separate a device configured to perform RIP processing requiring processing time and a device configured to perform printing processing from each other to increase the speed of printing. The processing executed by the printer controller 72*c* in the present invention may be executed by the higher-level device 71. In this case, the present invention may be embodied as an inkjet system including the higher-level device 71 as a control device and the printer device 72.

The image forming apparatus 100 according to the present invention exemplifies an inkjet recording apparatus as a liquid ejection apparatus in the present embodiment. The inkjet recording apparatus is an apparatus configured to drive a liquid ejection head to eject liquid. The liquid ejection apparatus is an apparatus including a liquid ejection head or a liquid ejection unit and configured to drive the liquid ejection head to eject liquid. The liquid ejection apparatus includes not only an apparatus that is capable of ejecting liquid on an object to which liquid can adhere but also an apparatus configured to eject liquid in the air or liquid.

The liquid ejection apparatus in the present embodiment is a recording apparatus (printer) configured to eject liquid from liquid ejection heads as in the image forming apparatus 100 to form an image on a recording medium, but is not limited to the one configured such that a significant image such as characters and figures is visualized by ejected liquid. Examples of the liquid ejection apparatus include a liquid ejection apparatus configured to form patterns that are meaningless themselves and a liquid ejection apparatus configured to form three-dimensional images.

The above-mentioned objects to which liquid can adhere means objects to which liquid can adhere at least temporarily, such as an object to which liquid adheres for fastness and an object to which liquid adheres for permeation. Specific examples thereof include recording media such as sheets, recording paper, recording sheets, films, and cloths, electronic components such as electronic substrates and piezoelectric elements (piezoelectric members), and media such as granular layers (powder layers), organ models, and test cells, and all kinds of objects to which liquid adhere are encompassed unless otherwise limited. The material to which liquid can adhere may be any material to which liquid can adhere at least temporarily, such as paper, thread, fiber, fabric, leather, metal, plastic, glass, wood, and ceramics.

According to an embodiment, the quality degradation of an image formed by ejecting liquid can be suppressed.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid ejection apparatus comprising:

a plurality of nozzles configured to eject liquid onto a conveyed object conveyed by a conveyance unit, based on input image data; and a control unit configured to control a number of droplets in a first flushing for ejecting the liquid onto the conveyed object and outside a region corresponding to the image data and a number of droplets in a second flushing for ejecting the liquid inside the region corresponding to the image data in addition to ejection based on the image data, the control unit being configured to control the number of droplets in the first flushing and the number of droplets in the second flushing based on at least a length of the image data in a direction in which the conveyed object is conveyed.

2. The liquid ejection apparatus according to claim 1, wherein the control unit is configured to control the number of droplets in the first flushing and the number of droplets in the second flushing further based on a type of the conveyed object.

3. The liquid ejection apparatus according to claim 1, wherein the control unit is configured to control the number of droplets in the first flushing and the number of droplets in the second flushing further based on a thickness of the conveyed object.

4. The liquid ejection apparatus according to claim 1, wherein the control unit is configured to control the number of droplets in the first flushing and the number of droplets in the second flushing further based on a drying condition set for the conveyed object.

5. The liquid ejection apparatus according to claim 1, wherein the control unit is configured to control the number of droplets in the first flushing and the number of droplets in the second flushing further based on a type of the liquid.

6. The liquid ejection apparatus according to claim 1, wherein the control unit is configured to control the number of droplets in the first flushing and the number of droplets in the second flushing further based on a recording resolution.

7. The liquid ejection apparatus according to claim 1, wherein the control unit is configured to control the number of droplets in the first flushing and the number of droplets in the second flushing further based on temperature and humidity.

8. The liquid ejection apparatus according to claim 1, wherein the control unit is configured to change a peak value in fine driving in accordance with the image data.

9. The liquid ejection apparatus according to claim 1, wherein the first flushing and the second flushing are combined on the basis of an image forming region of the conveyed object and a conveyance speed of the conveyed object.

10. The liquid ejection apparatus according to claim 1, wherein the control unit is further configured to combine the number of droplets in the first flushing with the number of droplets in the second flushing.

11. An inkjet system, comprising:

an inkjet recording apparatus configured to eject liquid from a plurality of nozzles onto a conveyed object conveyed by a conveyance unit, based on input image data; and a control apparatus configured to control a number of droplets in a first flushing for ejecting the liquid onto the conveyed object and outside a region corresponding to the image data and a number of droplets in a second flushing for ejecting the liquid inside the region corresponding to the image data in addition to ejection based on the image data, the control apparatus being configured to control the number of droplets in the first flushing and the number of droplets in the second flushing based on at least a length of the image data in a direction in which the conveyed object is conveyed.

12. A flushing method for ejecting liquid from a plurality of nozzles onto a conveyed object conveyed by a conveyance unit, to perform flushing, by an apparatus configured to eject the liquid based on input image data, the flushing method comprising:

setting, based on at least a length of the image data in a direction in which the conveyed object is conveyed, a number of droplets in a first flushing for ejecting the liquid onto the conveyed object and outside a region corresponding to the image data and a number of droplets in a second flushing for ejecting the liquid inside the region corresponding to the image data in addition to ejection based on the image data; and performing flushing based on the set number of droplets in the first flushing and the set number of droplets in the second flushing.

13. A liquid ejection apparatus comprising:

a plurality of nozzles configured to eject liquid onto a conveyed object conveyed by a conveyance unit, based on input image data; and a control unit configured to control a number of droplets in a first flushing for ejecting the liquid outside a region corresponding to the image data and a number of droplets in a second flushing for ejecting the liquid inside the region corresponding to the image data in addition to ejection based on the image data, the control unit being configured to control the number of droplets in the first flushing and the number of droplets in the second flushing based on at least a length of the image data in a direction in which the conveyed object is conveyed, wherein the control unit is configured to control the number of droplets in the first flushing and the number of droplets in the second flushing further based on a drying condition set for the conveyed object.

14. The liquid ejection apparatus according to claim 13, wherein the control unit is configured to change a peak value in fine driving in accordance with the image data.

* * * * *